US006652004B1

(12) United States Patent
Lam

(10) Patent No.: US 6,652,004 B1
(45) **Date of Patent: *Nov. 25, 2003**

(54) ITEM MADE FROM COMBINATION OF RARE AND COMMON MATERIALS AND METHOD OF MAKING THE SAME

(76) Inventor: Michael R. Lam, 36101 Bob Hope Dr., #E5-120, Rancho Mirage, CA (US) 92270

( * ) Notice: Subject to any disclaimer, the term of this patent is extended or adjusted under 35 U.S.C. 154(b) by 0 days.

This patent is subject to a terminal disclaimer.

(21) Appl. No.: 09/368,095

(22) Filed: Aug. 3, 1999

(51) Int. Cl.[7] ..... B42D 15/00

(52) U.S. Cl. ..... 283/74; 40/661; 206/457; 283/72; 283/117; 446/75

(58) Field of Search ..... 283/74, 72, 75, 283/117, 113; 446/74, 75; 206/457, 771, 449; 40/661

(56) References Cited

U.S. PATENT DOCUMENTS 1,859,635 A * 5/1932 Rose
1,877,229 A * 9/1932 Del Papa
1,899,421 A * 2/1933 More
2,021,070 A * 11/1935 Levine
2,204,037 A * 6/1940 Fernbach
2,665,003 A * 1/1954 Feigelman
3,767,203 A * 10/1973 Eaker ..... 273/157 R
3,928,089 A * 12/1975 Cech ..... 148/105
3,929,965 A * 12/1975 Kim et al. ..... 423/213.5
4,040,822 A * 8/1977 Stern ..... 75/140
4,435,915 A * 3/1984 Zaruba et al. ..... 46/12
4,527,688 A * 7/1985 Jones et al. ..... 206/457
4,740,187 A * 4/1988 Rasmussen et al. ..... 446/73
4,878,579 A * 11/1989 Hager ..... 206/84
4,915,214 A * 4/1990 Wieder ..... 206/0.82
4,964,831 A * 10/1990 Wolff ..... 446/268
4,979,609 A * 12/1990 Harlan et al. ..... 206/0.8
4,979,619 A * 12/1990 Hager ..... 206/509
5,040,671 A * 8/1991 Hager ..... 206/39
5,073,537 A * 12/1991 Hung et al. ..... 505/1
5,086,035 A * 2/1992 Hung et al. ..... 505/1
5,130,011 A * 7/1992 Sage, Jr. ..... 206/457
5,326,380 A * 7/1994 Yao et al. ..... 51/293
5,344,356 A * 9/1994 Pizzelli et al. ..... 446/73
5,353,925 A * 10/1994 Lennen et al. ..... 206/204
5,366,524 A * 11/1994 Holcombe, Jr. et al. ..... 51/293
5,380,047 A * 1/1995 Molee et al. ..... 283/74
5,398,455 A * 3/1995 Slavin et al. ..... 451/540
5,401,283 A * 3/1995 Dyer et al. ..... 51/293
5,429,393 A * 7/1995 Parlo ..... 283/75
5,433,643 A * 7/1995 Pratt ..... 446/73
5,702,294 A * 12/1997 Baltazar et al. ..... 451/540
5,758,777 A * 6/1998 Dods ..... 446/73
5,800,285 A * 9/1998 Thorne et al. ..... 473/324
5,803,501 A * 9/1998 Gluck ..... 283/75
5,899,503 A * 5/1999 Yoshizawa ..... 283/74
5,988,366 A * 11/1999 Krull et al. ..... 206/457
5,989,095 A * 11/1999 Wotton ..... 206/457
6,082,774 A * 7/2000 Schlauch ..... 283/67
6,151,823 A * 11/2000 Gregory-Gillman ..... 40/661
6,282,819 B1 * 9/2001 Gu ..... 40/124.03
6,475,634 B1 * 11/2002 Lam ..... 428/542.4

OTHER PUBLICATIONS

Sovietsri Collection Catalog, www.sovietski.com.*
Museum Replicas Unlimited, 1–800–883–8838.*

* cited by examiner

*Primary Examiner*—Monica Carter
(74) *Attorney, Agent, or Firm*—Fitch, Even, Tabin & Flannery

(57) ABSTRACT

An article of manufacture associated with a naturally-occurring or historically-related rare item includes a collectible item, a rare material or fragment derived from the rare item, and a certification of authenticity for attesting to the authenticity of the rare material or fragment. The collectible item may be formed from a mixture of the rare material and a common base material. The weight ratio of the base material to the rare material in the mixture is in the range of 1:1 to 1000:1 such that the rare material changes the color and/or the texture of the base material. Alternatively, the collectible item may be formed from a common base material, and the rare fragment may be coupled to the collectible item.

10 Claims, 6 Drawing Sheets

68

(Authenticating Company Name or TM) Serial No. 12345678-9

CERTIFICATE OF AUTHENTICITY

*This certifies that (description of this product), identified by Serial Number 12345678-9, contains, or has incorporated into it, a genuine fragment of (the original rare item), derived from (verified origin) on, or approximately (date). This product has been officially recorded and registered in the permanent records of the Company.*

*In witness whereof, the Company has caused this Certificate to be signed by it's duly authorized Officer and a designated Authenticator, and the Official Seal to be hereunto affixed this_____day of _____A.D._____.*

(Seal)

(signature)
Name & Title (President of Company)

(signature)
Name & Title Authenticating Authority

*FIG. 6*

ITEM MADE FROM COMBINATION OF RARE AND COMMON MATERIALS AND METHOD OF MAKING THE SAME

RELATED APPLICATIONS

This application claims the benefit of Provisional Application Ser. No. 60/095,125, filed Aug. 3, 1998.

FIELD OF THE INVENTION

This invention relates to collectible items and methods of making the same, and, in particular embodiments, a collectible item made from a combination of rare and common materials and a method of making the same.

BACKGROUND OF THE INVENTION

Generally, collectible items (such as dolls, toys, figurines, books, and the like) are commercially available for purchase by consumers. Naturally-occurring rare items (such as meteorites, fossils, and the like) and historically-related rare items (such as coal from the Titanic ocean liner, gold from Comstock Lode or Sutter's Mil, and the like) are also commercially available for purchase by consumers. However, such collectible items and rare items (or fragments of rare items) are traditionally sold separately. It would be desirable to join a collectible item with such rare items (or fragments of the rare items) into a single article of manufacture. Such articles of manufacture would enhance the value and consumer appreciation of the collectible item and the rare item joined into the single article over the collectible item and the rare item as separately sold. It would also be possible to include such rare items (or fragments of the rare items) in a vast, rather than limited, number of collectible items.

SUMMARY OF THE DISCLOSURE

It is an object of embodiments of the present invention to provide an improved article of manufacture which includes a collectible item and a naturally-occurring or historically-related rare item (or a fragment of the rare item) and a method of making the same, which obviate for practical purposes, the above mentioned limitations.

According to an embodiment of the present invention, an article of manufacture associated with a naturally-occurring or historically-related rare item includes a collectible item, which is made from a mixture of rare and common base materials, and a certification of authenticity for attesting to the authenticity of the rare material. The mixture of rare and base materials includes: (1) a common base material having a color and a texture, and (2) a rare material formed from the rare item and added to the base material. The weight ratio of the base material to the rare material in the mixture is in the range of 1:1 to 1000:1 such that the rare material changes the color and/or the texture of the base material.

In another embodiment of the present invention, an article of manufacture associated with a naturally-occurring or historically-related rare item includes: (1) a collectible item made from a common base material, (2) a rare fragment formed from the rare item and coupled to the collectible item, and (3) a certification of authenticity for attesting to the authenticity of the rare fragment. In particular embodiments of the present invention, the rare fragment is encased or sealed within a holder, and the holder is coupled to the collectible item.

In still another embodiment of the present invention, a method of making an article of manufacture associated with a naturally-occurring or historically-related rare item includes the following steps: (1) providing a common base material having a color and a texture; (2) forming a rare material from the rare item; (3) adding the rare material to the base material to form a mixture of the rare and the base materials; (4) forming a collectible item from the mixture of the rare and the base materials; and (5) creating a certification of authenticity for attesting to the authenticity of the rare material. The weight ratio of the base material to the rare material in the mixture is in the range of 1:1 to 1000:1 such that the rare material changes the color or the texture of the base material.

In yet another embodiment of the present invention, a method of making an article of manufacture associated with a naturally-occurring or historically-related rare item includes the following steps: (1) providing a collectible item made from a common base material; (2) forming a rare fragment from the rare item; (3) coupling the rare fragment to the collectible item; and (4) creating a certification of authenticity for attesting to the authenticity of the rare fragment. In particular embodiments of the present invention, the step of coupling the rare fragment to the collectible item further includes the following steps: (1) encasing the rare fragment within a holder; and (2) coupling the holder to the collectible item.

Other features and advantages of the invention will become apparent from the following detailed description, taken in conjunction with the accompanying drawings, which illustrate, by way of example, various features of embodiments of the invention.

BRIEF DESCRIPTION OF THE DRAWINGS

A detailed description of embodiments of the invention will be made with reference to the accompanying drawings, wherein like numerals designate corresponding parts in the several figures.

FIG. 6 is a front view of a form of certificate of authenticity that can be used with the doll shown in FIG. 1 and the toy shown in FIG. 2.

DETAILED DESCRIPTION OF THE PREFERRED EMBODIMENTS

Figure 1:
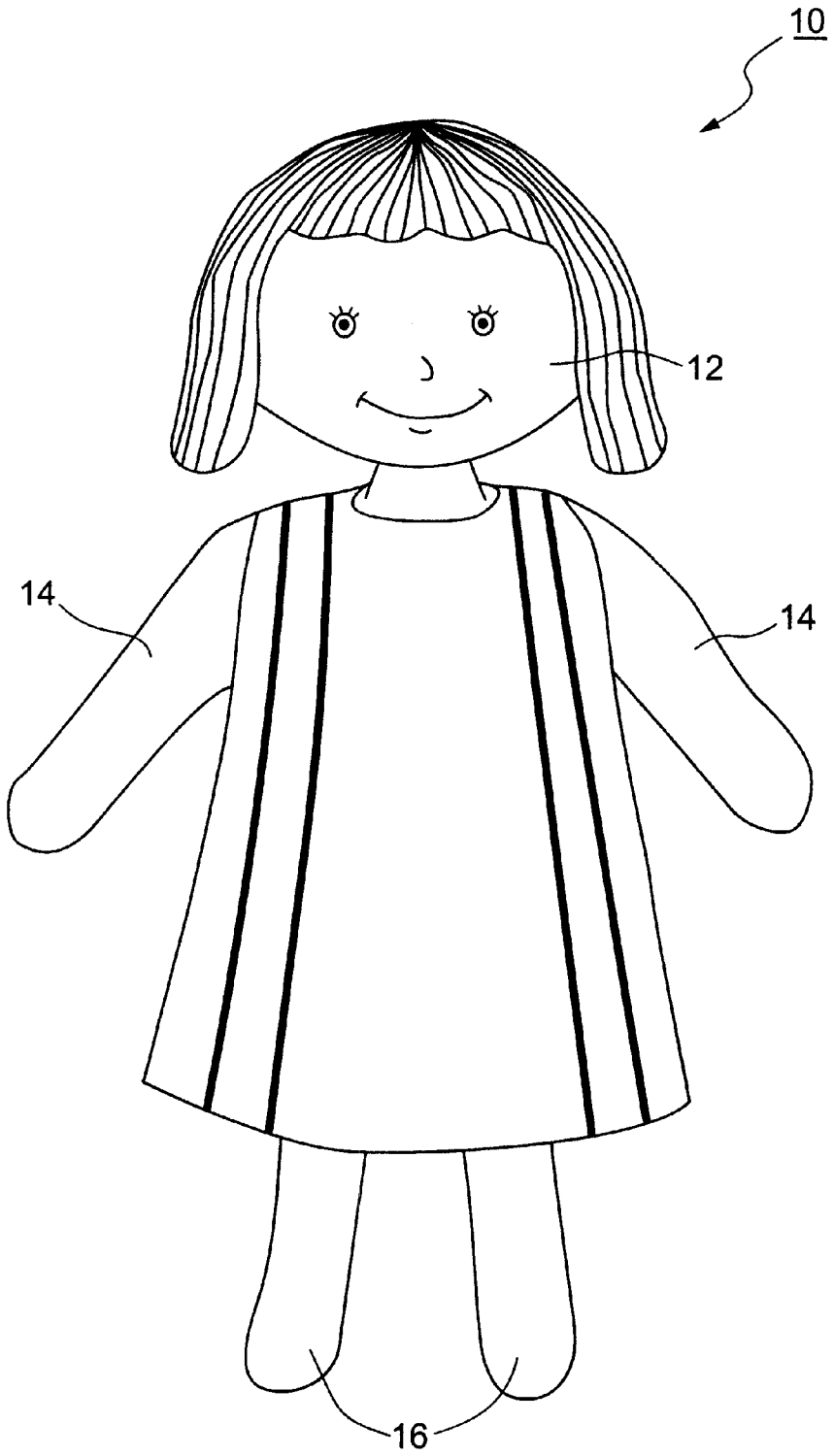
FIG. 1 is a perspective view of a doll made from a combination of rare and common materials in accordance with a first embodiment of the present invention.

As shown in the drawings for purposes of illustration, the invention is embodied in a collectible item made from a combination of rare and common materials and a method of making the same. In preferred embodiments of the present invention, the collectible item is a doll, toy, figurine, or the like. The rare material is taken or derived from either a rare item occurring in nature, such as a meteorite, or a rare item related to a historical person, place, object, or event, such as coal salvaged from the Titanic ocean liner. The rare material is added to a common or base material (such as plastic, resin, cloth, ceramic, metal, composites, or the like) to form a mixture of the rare and base materials such that the rare material changes the color and/or the texture of the base material. The collectible item is then formed from the mixture of the rare and base materials. A certification of authenticity for attesting to the authenticity of the rare material is also included with the collectible item. However, it will be recognized that further embodiments of the invention may use other types of collectible items and may include the rare item with the collectible item in other manners. In alternative embodiments, the collectible item may be a book, souvenir, household good, or the like. In further alternative embodiments, the rare material may be derived from other types of naturally-occurring rare items, such as fossils, or historically-related rare items, such as stones from the Egyptian pyramids, gold from Comstock Lode or Sutter's Mill, or the like. In still further alternative embodiments, the rare item may be included with the collectible item in other manners, such as by coupling a holder containing the rare item (or a fragment of the rare item) to the collectible item, or the like.

FIG. 1 illustrates a collectible item 10 made from a combination of rare and common materials in accordance with a first embodiment of the present invention. In the illustrated embodiment, the collectible item is a doll 10 with its head 12, arms 14, and legs 16 made from a mixture of a common base material and a rare material. The base material is derived from liquid polyvinyl chloride or plastisol. The base material has a white color and a generally smooth texture. The rare material is derived from a naturally-occurring rare item (not shown), such as a meteorite or a fossil. The rare material has a brown or red color and a dust-like consistency. In alternative embodiments, the base material and the rare material may be or may be derived from other materials or items and have different colors and/or textures. In preferred embodiments, the weight ratio of the base material to the rare material in the mixture of materials is in the range of 1:1 to 1000:1. By virtue of such a weight ratio, the rare material causes a change in the color and/or the texture of the base material, and thus, inclusion of the rare material in the doll 10 is easily detected by the naked eye. In the illustrated embodiment, addition of the rare material to the base material results in a light brown or rust colored mixture of materials, and thus, the head 12, arms 14, and legs 16 of the doll 10 have a light brown or rust color.

In preferred embodiments, the doll 10 shown in FIG. 1 also includes a certification of authenticity for attesting to the authenticity of the rare material. In one embodiment, the certification of authenticity is a certificate of authenticity 68 (FIG. 6) included with the doll 10 The certificate of authenticity includes two signatures: (1) the signature of an expert fully qualified to represent that the rare material was formed from the rare item and that the doll 10 was formed from a combination of the rare and base materials, and (2) the signature of the manufacturer of the doll 10. The certificate of authenticity 68 attests to the identity and source of the rare material, and thus, attests to the authenticity of the rare material. In alternative embodiments, the certification of authenticity may be an inscription or other marking on the doll 10 itself.

Figure 2:
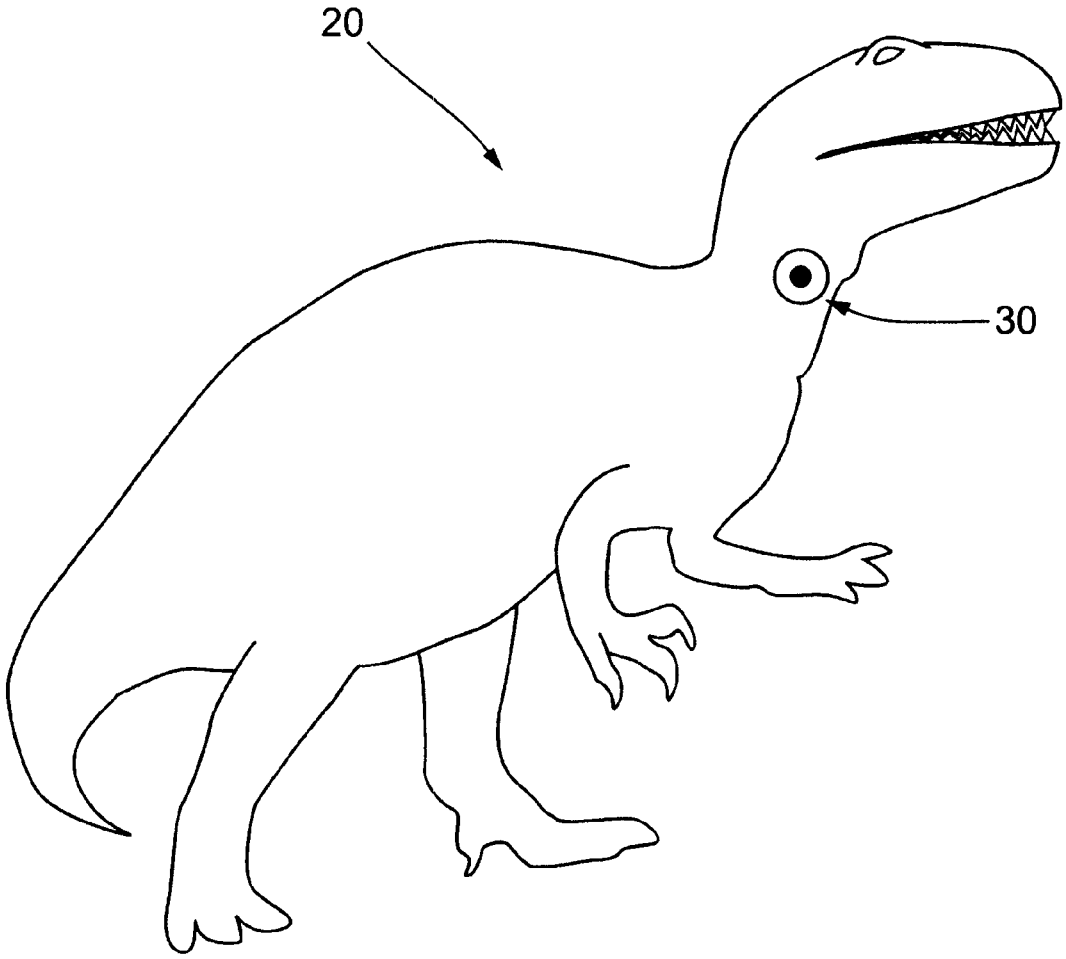
FIG. 2 is a perspective view of a toy with a holder containing a rare fragment and attached to the toy in accordance with a second embodiment of the present invention.

FIG. 2 illustrates a collectible item 20 with a holder 30 containing a rare fragment 32 and coupled to the collectible item 20 in accordance with a second embodiment of the present invention. In the illustrated embodiment, the collectible item is a toy 20. A holder 30 contains a rare fragment 32 and is attached to the toy 20. The rare fragment 32 is derived from a naturally-occurring rare item (not shown), such as a fossil. The rare fragment 32 is of a sufficient size to be visible to the naked eye. The rare fragment 32 is preferably round in shape, but may also be rectangular, triangular, or the like. In preferred embodiments, the holder 30 has a transparent window 31 (preferably made of plastic or glass) and a base 40. The base 40 includes a holder backing 36 (preferably made of plastic or metal) that is attached to an attachment section 38 (preferably made of stiff paper, plastic, metal, or cloth) using an adhesive 37 and a window backing 34 (preferably made of stiff paper or plastic) that is attached to the holder backing 36 using an adhesive 35. The rare fragment 32 is encased or sealed within the window 31, and the window 31 is attached to the window backing 34 of the base 40 using an adhesive 33. The attachment section 38 of the holder 30 is attached to the toy 20 using adhesive. In alternative embodiments, the window 31, the window backing 34, the holder backing 36, and the attachment section 38 may be made of other materials, such as metals, ceramics, composites, or the like. In further alternative embodiments, the window 31 may be attached to the window backing 34 of the base 40, the window backing 34 may be attached to the holder backing 36, the holder backing 36 may be attached to the attachment section 38, and the attachment section 38 of the holder 30 may be attached to the toy 20, using fasteners, such as screws, nails, bolts, or the like, or through processes, such as sewing, heat transfer, or the like. In other alternative embodiments, the window backing 34, the holder backing 36, and/or the attachment section 38 may be omitted.

Figure 3A:
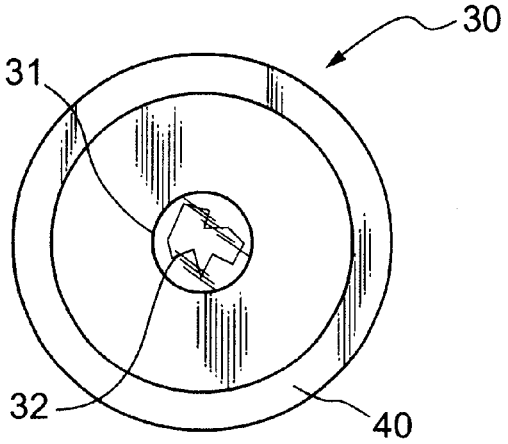
FIGS. 3*a*–3*c* are exploded top plan, side plan, and perspective views of the holder containing the rare fragment shown in FIG. 2.
Figure 3B:
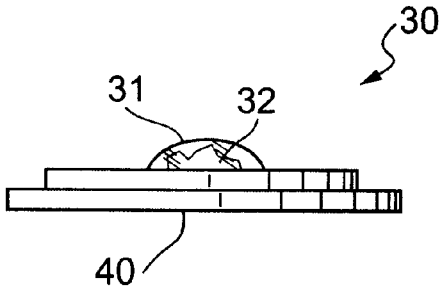
Figure 3C:
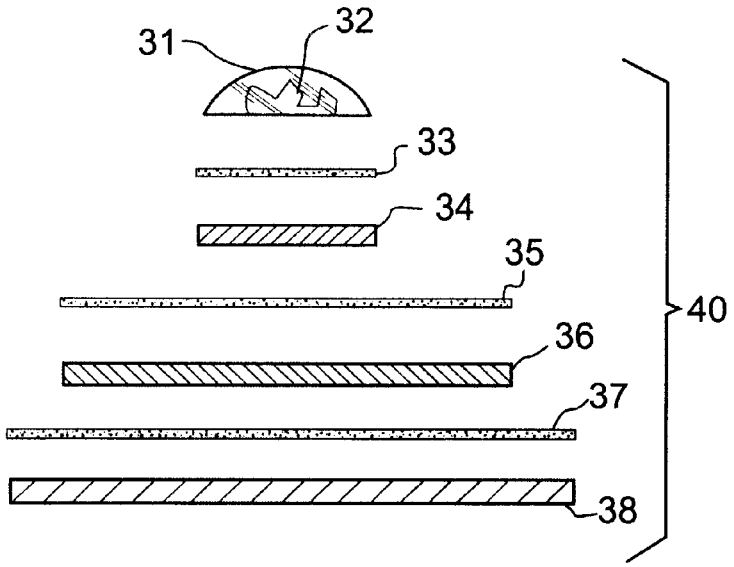

In preferred embodiments, the toy 20 shown in FIGS. 2–3*c* also includes a certification of authenticity for attesting to the authenticity of the rare fragment 32. In one embodiment, the certification of authenticity is a certificate of authenticity 68 (FIG. 6) included with the toy 20. The certificate of authenticity includes two signatures: (1) the signature of an expert fully qualified to represent that the rare fragment 32 was formed from the rare item, and (2) the signature of the manufacturer of the toy 20. The certificate of authenticity 68 attests to the identity and source of the rare fragment 32, and thus, attests to the authenticity of the rare fragment 32. In alternative embodiments, the certification of authenticity may be an inscription or other marking on the toy 20 itself.

Figure 4:
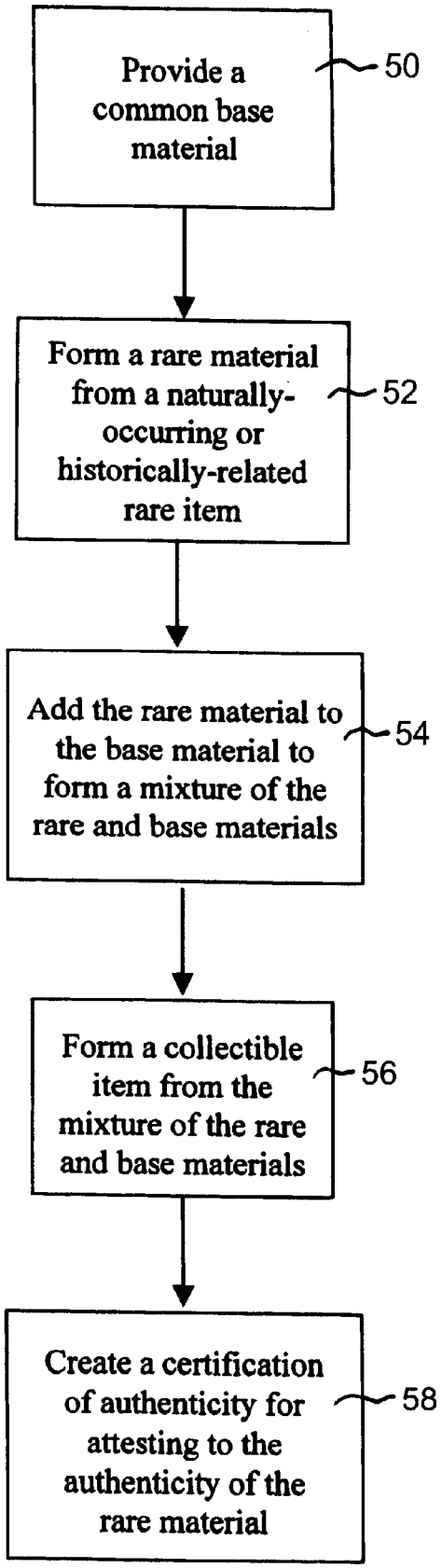
FIG. 4 is a flowchart describing a method of making the doll shown in FIG. 1.

With reference to FIG. 4, a method of making the doll 10 from the combination of the rare and base materials shown in FIG. 1 will now be described. At step 50, a common base material is provided, such as a base material derived from liquid polyvinyl chloride or plastisol. However, in alternative embodiments, the base material may be other materials, such as plastic, ceramic, metal, composites, or the like, and may have other forms, such as powder or the like. At step 52, a rare material is derived from a naturally-occurring rare item (not shown), such as a meteorite or a fossil, or a historically-related rare item (not shown), such as coal from the Titanic ocean liner. The rare material is formed by crushing or pulverizing the rare item to a dust-like consistency. However, in alternative embodiments, the rare material may be derived from other naturally-occurring items, such as rare metals, plants, or the like, or historically-related items. In further alternative embodiments, the rare material may be formed using other processes, such as shredding, grinding, smashing, milling, cutting, or the like. In still further embodiments, the rare material may be prepared into other forms and consistencies, such as small fragments, sand-sized grains, powder, or the like.

At step 54, the rare material is mixed with the base material to form a mixture of the rare and base materials. In preferred embodiments, the weight ratio of the base material to the rare material in the mixture is in the range of 1:1 to 1000:1. By virtue of such a weight ratio, the rare material causes a change in the color and/or texture of the base material, and thus, inclusion of the rare material in the doll 10 is easily detected by the naked eye.

At step 56, the doll 10 is formed from the mixture of the rare and base materials. In the embodiment illustrated in FIG. 1, the head 12, arms 14, and legs 16 of the doll 10 are cast using a "rotomolding" process. However, in alternative embodiments, the head 12, arms 14, and legs 16 of the doll 10 may be formed using other processes, such as injection molding or the like. In further alternative embodiments, other parts of the doll 10 or the entire doll 10 may be formed from the mixture of the rare and base materials.

At step 58, a certification of authenticity is created for attesting to the authenticity of the rare material. In one embodiment, the certification of authenticity is a certificate of authenticity 68 included with the doll 10. The certificate of authenticity represents that the rare material was formed from the rare item and that the doll 10 was formed from a combination of the rare and base materials. The certificate of authenticity attests to the identity and source of the rare material, and thus, attests to the authenticity of the rare material. In alternative embodiments, the certification of authenticity may be inscribed or otherwise marked directly on the doll 10 itself.

Figure 5:
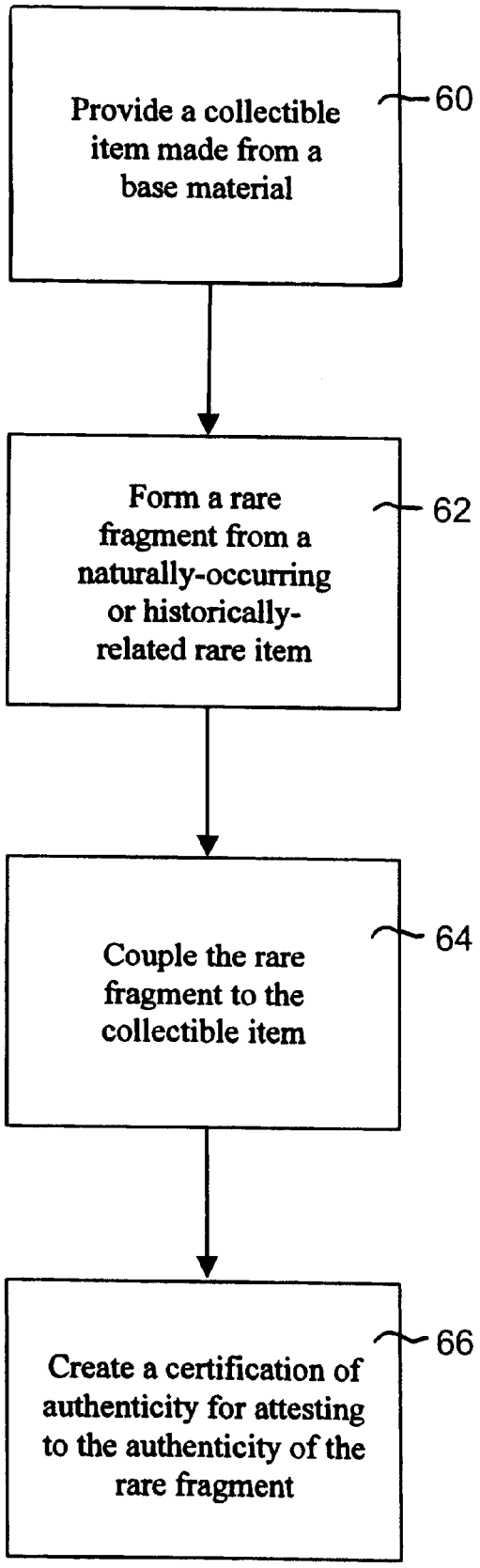
FIG. 5 is a flowchart describing a method of making the toy with the holder containing the rare fragment shown in FIGS. 2–3*c*.

With reference to FIG. 5, a method of making the toy 20 with the holder 30 containing the rare fragment 32 and attached to the toy 20 shown in FIGS. 2–3*c* will now be described. At step 60, the toy 20 made from the common base material is provided. At step 62, the rare fragment 32 is derived from the naturally-occurring rare item (not shown), such as a fossil, or the historically-related rare item (not shown), such as gold from Comstock Lode or Sutter's Mill. The rare fragment 32 is formed by cutting or crushing the rare item into small fragments of various sizes and shapes. The rare fragment 32 is of a sufficient size to be visible to the naked eye. The rare fragment 32 is preferably round in shape, but may also be rectangular, triangular, or the like.

At step 64, the rare fragment 32 is coupled to the toy 20. In the embodiment illustrated in FIGS. 2–3*c*, the rare fragment 32 is first encased or sealed within the holder 30. The holder 30 includes the window 31 and the base 40. The base 40 is formed by attaching the holder backing 36 to the attachment section 38 using the adhesive 37 and attaching the window backing 34 to the holder backing 36 using the adhesive 35. The rare fragment 32 is encased or sealed within the window 31, and the window 31 is attached to the window backing 34 of the base 40 using the adhesive 33. The holder 30 is then attached to the toy 20 by attaching the attachment section 38 of the holder 30 to the toy 20 using adhesive. In alternative embodiments, the holder 30 may be omitted, and the rare fragment 32 may be attached directly to the toy 20. In further alternative embodiments, the window 31 may be attached to the window backing 34 of the base 40, the window backing 34 may be attached to the holder backing 36, the holder backing 36 may be attached to the attachment section 38, and the attachment section 38 of the holder 30 may be attached to the toy 20, using fasteners, such as screws, nails, bolts, or the like, or through processes, such as sewing, heat transfer, or the like. In other alternative embodiments, the window backing 34, the holder backing 36, and/or the attachment section 38 may be omitted.

At step 66, a certification of authenticity is created for attesting to the authenticity of the rare fragment 32. In one embodiment, the certification of authenticity is a certificate of authenticity 68 included with the toy 20. The certificate of authenticity attests to the identity and source of the rare fragment 32, and thus, attests to the authenticity of the rare fragment 32. In alternative embodiments, the certification of authenticity may be inscribed or otherwise marked directly on the toy 20 itself.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An article of manufacture associated with a naturally-occurring or historically-related rare item made from a rare material, the article comprising:

a collectible item made from a common base material that is different from the rare material;

a holder coupled to the collectible item;

a rare fragment formed from the rare item and having a shape that is different from the shape of the collectible item, said fragment being permanently encased within the holder coupled to the collectible item; and a certification of authenticity for attesting to the authenticity of the rare fragment.

2. The article of claim 1, wherein the certification of authenticity is a certificate of authenticity associated with the article, and further wherein the certificate of authenticity includes:

a signature of an expert qualified to represent that the rare fragment was formed from the rare item; and a signature of a manufacturer of the article.

3. The article of claim 1, wherein the certification of authenticity is inscribed on the article.

4. A method of making an article of manufacture associated with a naturally-occurring or historically-related rare item made from a rare material, the method comprising the steps of:

providing a collectible item made from a common base material that is different from the rare material;

forming a rare fragment from the rare item, said fragment having a shape that is different from the shape of the collectible item;

permanently encasing the rare fragment within a holder;

coupling the holder to the collectible item; and creating a certification of authenticity for attesting to the authenticity of the rare fragment.

5. A method of enhancing the value of a collectible item comprising:

obtaining at least a fragment of a rare item;

encasing said fragment in a holder;

packaging said holder with said collectible item; and providing a certificate of authenticity with said collectible item, said certificate of authenticity authenticating said fragment.

6. The method of claim 5 wherein said packaging of said holder with said collectible item comprises attaching said holder to said collectible item.

7. A method of mounting a rare item for display comprising:

obtaining at least a fragment of said rare item;

encasing said fragment in a holder;

attaching said holder to a collectible item selected from the group consisting of a toy, a figurine, and a souvenir; and providing a certificate of authenticity with said collectible item, said certificate of authenticity authenticating said fragment.

8. The method of claim 7 herein said rare item is selected from the group consisting of a naturally occurring item, an item associated with a historical place of significance, an item associated with a historical person of significance, an item associated with a historical event of significance, and an item associated with a historical object of significance.

9. The method of claim 8 wherein said naturally occurring item is selected from the group consisting of a meteorite, a fossil, and gold.

10. A dually-collectible item comprising:

a collectible item selected from the group consisting of a toy, a figurine, and a souvenir;

a holder coupled to said collectible item, said holder holding at least a fragment of a rare item, said rare item being selected from the group consisting of a naturally occurring item, an item associated with a historical place of significance, an item associated with a historical person of significance, an item associated with a historical event of significance, and an item associated with a historical object of significance; and a certificate of authenticity coupled to said collectible item and said holder, said certificate of authenticity authenticating said fragment.

* * * * *